US005644877A

United States Patent [19]

Wood

[11] Patent Number: 5,644,877

[45] Date of Patent: Jul. 8, 1997

[54] DEMOUNTABLE CEILING CLOSURE

[76] Inventor: Richard J. Wood, 18 Fox Chase Rd., Bloomfield, Conn. 06002

[21] Appl. No.: 506,826

[22] Filed: Jul. 25, 1995

[51] Int. Cl.[6] ..... E04H 1/00

[52] U.S. Cl. ..... 52/241; 52/242; 52/126.3

[58] Field of Search ..... 52/241, 242, 126.3, 52/126.4, 239, 238.1, 220.5, 220.7, 220.6, 243.1

[56] References Cited

U.S. PATENT DOCUMENTS

| | | | |
|---|---|---|---|
| 3,255,564 | 6/1966 | Downes | 52/242 X |
| 3,411,252 | 11/1968 | Boyle, Jr. . | |
| 3,460,302 | 8/1969 | Cooper . | |
| 3,477,186 | 11/1969 | Birum, Jr. . | |
| 3,885,361 | 5/1975 | De Schutter . | |
| 4,080,766 | 3/1978 | Jastrabek . | |
| 4,229,918 | 10/1980 | Delcroix . | |
| 4,454,690 | 6/1984 | Dixon . | |
| 4,798,035 | 1/1989 | Mitchell et al. . | |
| 4,833,848 | 5/1989 | Guerin . | |
| 5,471,805 | 12/1995 | Becker . | |

*Primary Examiner*—Lanna Mai
*Attorney, Agent, or Firm*—M. P. Williams

[57] ABSTRACT

A ceiling closure above a portable wall (FIG. 6) includes wall panels (14, 15) having upper edges entrained by channels (17, 19) formed of legs (24–27) of a ceiling track. The closure is rendered demountable by having lower panel support channels formed by legs (31, 32) and L-shaped members (33, 34) having a lip (46) with a vertical component interfering with a corresponding lip 47 on a panel support track (36). The L-shaped member is held in place by virtue of the weight of the wall panel which it entrains. One and two panel embodiments are shown; vertical height adjustment (50) is provided.

7 Claims, 3 Drawing Sheets

DEMOUNTABLE CEILING CLOSURE

TECHNICAL FIELD

This invention relates to office-type wall paneling, particularly suited to closing off space between partitions and a ceiling.

BACKGROUND ART

In office buildings it is common to use modular wall systems, rather than walls made of building materials, to permit flexibility in rearranging the room or cubicle configurations of the offices. For greatest flexibility, use is made of system furniture wall panels, which are normally not fastened in any fashion to the building, and which derive their stability from adjacent similar panels and furniture. Heretofore, such use has been limited to providing cubicle-type enclosures, these may typically be four feet (counter high), seven feet (head high), or eight feet, or so, in height. However, they are not readily utilized for closed offices because of irregularities in the building structure which precludes manufacture of prefabricated, furniture-type wall structures which can be used for a complete ceiling to floor arrangement. Of course, other semi-custom partitioning systems may be utilized to provide modular walls of various sizes, as is known in the art. Examples of these are shown in U.S. Pat. Nos. 4,018,020; 3,593,475; and 4,086,734; and UK application 2,049,013. While these are easy to assemble and generally utilize paneling which can be cut to the desired size and shape, thereby to accommodate the individual needs of each installation, they are difficult to take apart, and therefore do not serve as an adjunct to readily-movable system furniture wall paneling, which instead requires adjunctive ceiling panels (that is, panels between the top of the system furniture wall panel and the ceiling) that are fully demountable, in order to retain the versatility of the system furniture wall paneling.

DISCLOSURE OF INVENTION

Objects of the invention include easily installed, customized paneling which may be utilized to close the gap between the system furniture wall paneling and the ceiling, and which is readily demountable so as to permit moving the system furniture wall paneling.

The invention is predicated on my discovery that the weight of the paneling itself can be used in conjunction with a very small lip to provide a very secure yet readily demountable custom wall panel.

According to the present invention, a demountable ceiling panel, for enclosing the space between portable system furniture wall paneling and a ceiling (or other modular wall structures) includes panel members held in place by channel structures, with a panel supporting structure being completed by the insertion of an L-shaped strip having a small lip which is caused by the weight of the panel members to engage a similar lip in the channel structure; demountability is easily achieved by simply raising the paneling to allow disengagement of the lip, removal of the L-shaped portion and thereafter removal of the paneling. The panel supporting structure may be leveled by an adjusting bolt.

While the invention is designed principally for use with system furniture wall paneling of a completely portable variety, the invention may also be used with other modular wall systems, as desired. Although its preferred form is utilized with two spaced-apart panels, such as paper-faced gypsum board, the invention is also useable with single panels, if desired. The panels may be painted or covered with vinyl, paper, fabric or other sheeting.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
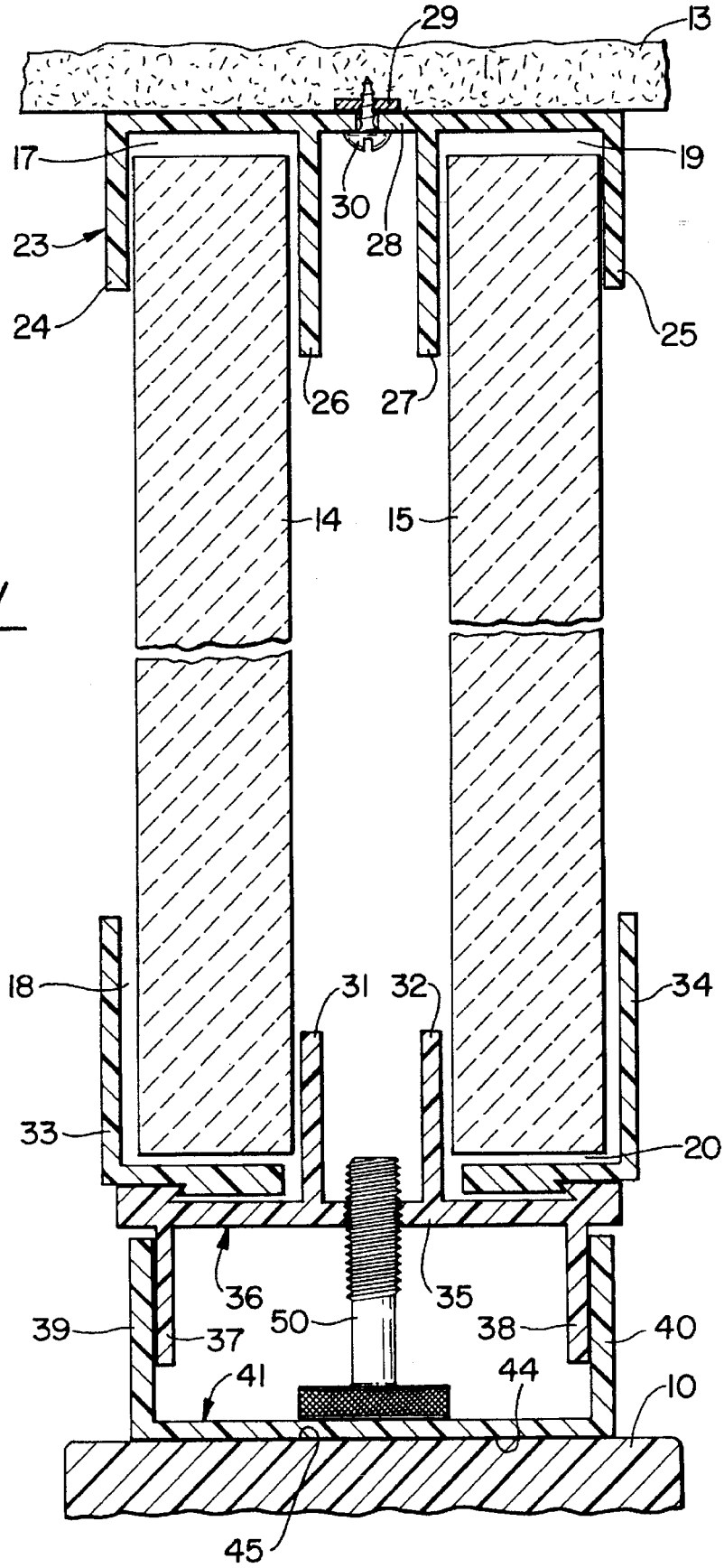
FIG. 1 is a sectioned end elevation view of a preferred, two-panel embodiment of the invention.

Referring now to FIG. 1, the present invention provides a ceiling closure between the top trim piece 10 of a system furniture wall panel and the ceiling 13 in an office building. The invention serves to mount panels 14, 15 of suitable wall structure material, such as ordinary paper-faced gypsum board (preferably fire code). The panels 14, 15 each rest within a pair of corresponding upper elongated U-shaped channels 17, 19, the channels 17, 19 being formed within a single piece ceiling track 23 which has four legs 24–27 extending from a flat, planar base portion 28. The upper surface of the base portion 28 is in contact with the ceiling 13, the piece 23 being secured to the ceiling 13, or a metal support thereof 29, in any suitable way, such as by means of a screw 30.

The lower channels 18, 20 are formed by a pair of fixed legs 31, 32 and a pair of separate L-shaped members 33, 34. The fixed legs 31, 32 extend upwardly from a flat planar portion 35 of a panel support track 36, which also has two legs 37, 38 extending downwardly therefrom. These legs fit between corresponding, upwardly extending legs 39, 40 of a bottom track 41 which comprises an elongated, U-shaped channel. The bottom surface 44 of the track 41 may be attached to the upper surface 45 of the trim piece 10 by means of double-sticky tape, or by any other form of suitably releasable adhesive that will permit cleaning up the trim 10 after removing the bottom track 41 when the ceiling closure of the invention is to be moved.

Figure 2:
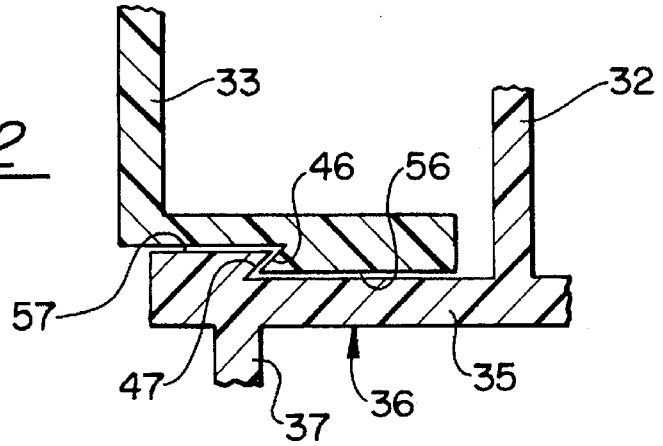
FIG. 2 is an expanded, partial end elevation view of the embodiment of FIG. 1.
Figure 2:
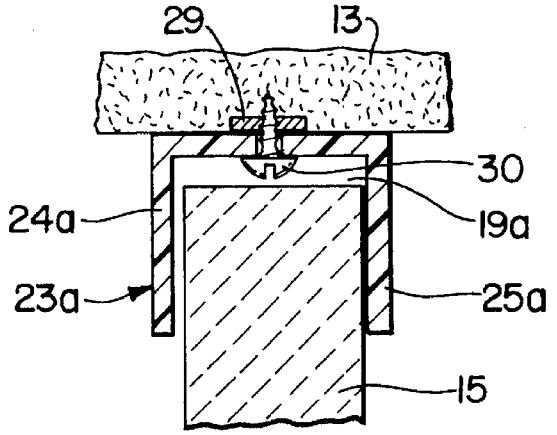
Figure 3:
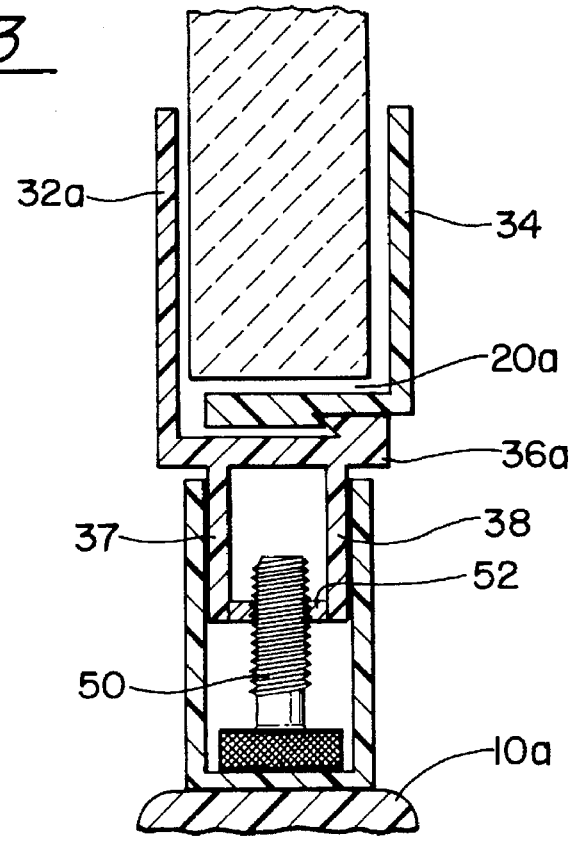
FIG. 3 is a sectioned end elevation view of an alternative, single-panel embodiment of the invention.

The heart of the present invention is that the L-shaped members 33, 34 and the panel support member 36 each have mutually-interfering lips 46, 47 as shown in FIG. 2. In the disclosed embodiment, the lips 46, 47 are at about a 45° angle; however, this angle is not critical and in fact the angle can be greater or lesser, up to and including 90°, or more. The important aspect is that the weight of the panels 14, 15 ensure interference between the lips 46 and 47 after the L-shaped pieces 33, 34 are inserted and the panels 14, 15 are allowed to rest thereon. The panels 14, 15 are cut with a vertical dimension to allow space above them, so that they may be raised up to facilitate insertion and removal of the L-shaped members 33, 34. The legs 26, 27 are longer than the legs 24, 25 so as to facilitate inserting the panels 14, 15 into their corresponding channels 17, 19. However, as seen in FIG. 3, this is not essential to the invention. Adjusting bolts 50 are threaded into the panel support track 36, periodically, along the whole length of the track; this allows leveling the panel support track 36 to compensate for any variation in the height of furniture panel top trim piece 10.

Installation may be effected by first securing the bottom track 41 to the top of the system furniture wall panel 10 and securing the ceiling track 23 to the ceiling 13 in the desired location; and then the system furniture wall panel may be plumbed beneath the ceiling track. Alternatively, the system furniture wall panel may be located first, and the ceiling track then aligned immediately above the bottom track 41. The panel support track 36 is inserted in the bottom track 41 and the height thereof (level) is adjusted with the bolt 50. Then, one of the panels 14, 15 is inserted in the appropriate channel 17, 19 of the ceiling track 23 and allowed to rest on the support track 36 adjacent to and in contact with the corresponding upwardly-extending legs 31, 32. One end of the corresponding L-shaped member 33, 34 can then be inserted under a panel 14, 15 followed by pressuring an increasing amount of the L-shaped members 33, 34 so that the entire member becomes seated beneath the panel 14, 15 (in much the same fashion as closure of a lip-lock bag). The spacing is exaggerated in FIG. 1, there normally only being relatively close clearance fit between the various parts when everything is installed.

To demount the ceiling closure of the invention, either panel 14, 15 is lifted so as to take the weight off of one end of the corresponding L-shaped member 33, 34 which is then pushed inwardly so that the lips 46, 47 will clear each other, after which the L-shaped member 33, 34 can be lifted and slid outwardly from beneath the corresponding panel 14, 15, and be completely removed from the assembly. Thereafter, each panel 14, 15 can have its lower edge moved outwardly, and be completely removed from the assembly. Then, the panel support track 36, together with the adjusting bolts 50 are raised out of the bottom track 46 and removed. Thereafter, the bottom track 41 is stripped off of the system furniture panel trim 10 and the upper track 23 is unscrewed from the ceiling 13 (or its metal supports 29).

The embodiment of FIG. 1 utilizes two panels 14, 15 and is well suited to provide a ceiling closure with a finished look above normal system furniture wall panels, which are typically about two inches thick. However, the embodiment of FIG. 3, utilizing only a single panel 15, may be used with much thinner system furniture wall paneling having a thinner trim piece 10*a*. In such a case, the upper track 23*a* provides only a single channel 19*a* formed of two short, downwardly extending legs 24*a*, 25*a*. The support track 36*a* has an upwardly extending leg 32*a* of sufficient length to provide a finished look the same as the height of the L-shaped member 34 (which may be the same in both embodiments). The support track 36*a* has one or more cross piece 52 between the downwardly extending legs 37, 38 to receive the vertical adjusting bolts 50. The cross piece 52 may comprise short sections periodically along the length of the track 36*a*, or may extend throughout the length thereof.

Figure 4:
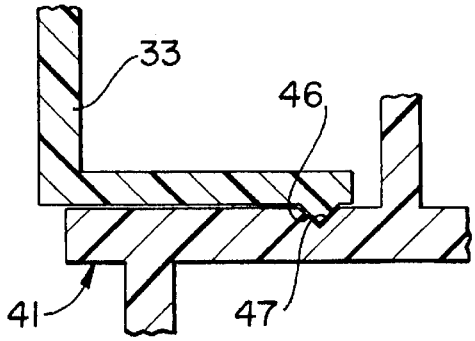
FIG. 4 is an expanded, partial end elevation view of a second embodiment.
Figure 5:
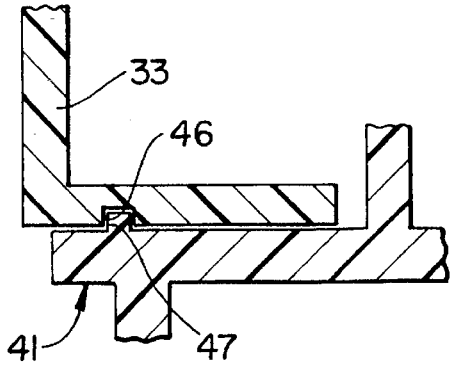
FIG. 5 is an expanded, partial end elevation view of a third embodiment.

In the embodiments of FIGS. 1–3, the lips 46, 47 comprise acute angular escarpments of corresponding mesas 56, 57 (FIG. 2). However, lips 46, 47 may comprise faces at obtuse angles to the surfaces from which they extend, or 90° angles, as shown in FIGS. 4 and 5. The lip 46 may be formed on a protrusion from the L-shaped member 18 as shown in FIG. 4 or lip 46 may be formed by a notch within the L-shaped member 18 as shown in FIG. 5. Similarly, the lip 47 may be formed in a groove in the support track 41 or may be formed on a ridge extending upwardly from the support track 41. The lips 46, 47 may thus be in a variety of angles and formed in a variety of ways within the purview of the invention. The acute angle lips of FIGS. 1–3 are preferred because it is believed that these hold the L-shaped members 33, 34 more uniformly in contact with the panel support track 36, thereby providing a better appearance, particularly if the bottom edge of a panel is not straight. However, lips having vertical components of a wide variety of shapes and angles may well serve to cause the L-shaped members 33, 34 to remain in place and thus entrain the bottom edge of the panels 14, 15 sufficiently, according to the invention.

Figure 6:
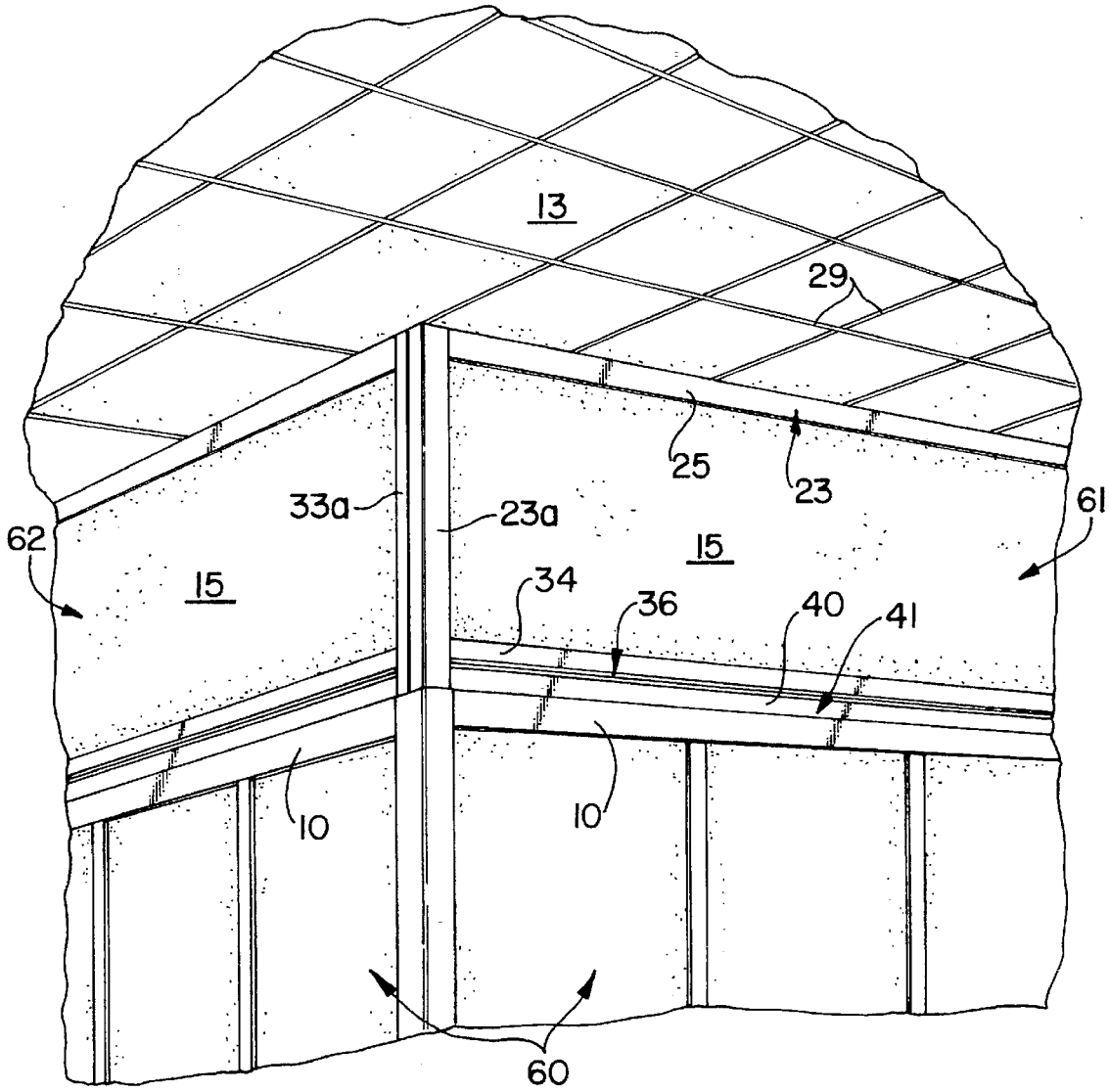
FIG. 6 is a perspective view of a pair of wall closures of the invention, meeting at a corner, above a portable wall.

FIG. 6 illustrates a ceiling closure of the invention disposed on a portable, furniture-like wall structure 60. To make a corner, a piece of ceiling track 23*a* may be fitted to the butt end of one wall 61, by removing end portions of the legs 26, 27 and/or the legs 24, 25 (FIG. 1) if desired so as to clear other tracks, in an obvious way. A length of L-shaped member 33*a* may be used to trim the joint between the walls 61, 62, if desired.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A wall panel mounting system for temporarily mounting a panel of structural wall material to form a demountable ceiling closure between a portable, furniture-type wall and a ceiling, comprising:

an elongated bottom track having a bottom surface for securing said ceiling closure to the top of said furniture-type wall and having a first pair of longitudinal legs extending upwardly which form a U-shaped channel;

an elongated ceiling track having a base portion for securing said ceiling closure to a ceiling above said bottom track and having a second pair of longitudinal legs extending downwardly therefrom which form a U-shaped channel to entrain the upper edge of said panel;

an elongated panel support track having a first horizontal surface with a first longitudinal leg extending upwardly therefrom, and with a first longitudinal lip extending therefrom, said lip comprising an escarpment facing said first upwardly extending leg, and having a third pair of longitudinal legs extending downwardly, said third pair of legs fitting within the channel of said bottom track, so that said bottom track locates and supports said panel support track; and an elongated L-shaped member having a second longitudinal leg extending upwardly and having a second horizontal surface with a second longitudinal lip extending therefrom, said second lip comprising an escarpment adjacent to the escarpment of said first lip with said L-shaped member resting on said panel support track so that said first leg and said L-shaped member form a U-shaped channel to entrain the lower edge of said panel.

2. A system according to claim 1 wherein said lips each comprise an escarpment at an acute angle with respect to the surface from which it extends.

3. A system according to claim 1 wherein said panel support track has a plurality of threaded, vertical holes engaging a plurality of corresponding vertical adjustment bolts, the position of said bolts determining a minimum distance between said panel support track and said bottom track, and therefore determining the height of the bottom edge of said panel above said bottom surface.

4. A system according to claim 1 wherein:

said elongated ceiling track has a fourth pair of longitudinal legs extending downwardly therefrom which form a second U-shaped channel to entrain the upper edge of a second panel of structural wall material;

said elongated panel support track has a second horizontal surface with a third leg extending upwardly therefrom, and with a third longitudinal lip extending therefrom, said third lip comprising an escarpment facing said third upwardly extending leg; and a second elongated L-shaped member having a fourth longitudinal leg extending upwardly therefrom and having a fourth horizontal surface with a fourth longitudinal lip extending therefrom, said fourth lip comprising an escarpment adjacent to the escarpment of said third lip with said second L-shaped member resting on said panel support track so that said fourth leg and said second L-shaped member form a U-shaped channel to entrain the lower edge of said second panel.

5. A wall panel mounting system for temporarily mounting first and second panels of structural wall material to form a demountable, double ceiling closure between a portable, furniture-type wall and a ceiling, comprising:

an elongated bottom track having a bottom surface for securing said ceiling closure to the top of said furniture-type wall and having a first pair of longitudinal legs extending upwardly which form a U-shaped channel;

an elongated ceiling track having a base portion for securing said ceiling closure to a ceiling above said bottom track and having second and third pairs of longitudinal legs extending downwardly therefrom which form first and second U-shaped channels to entrain the respective upper edge of a corresponding one of said panels;

an elongated panel support track having a first horizontal surface with a first longitudinal leg extending upwardly therefrom, and with a first longitudinal lip extending therefrom, said first lip comprising an escarpment facing said first upwardly extending leg, and having a second horizontal surface with a second leg extending upwardly therefrom, and with a second longitudinal lip extending therefrom, and said second lip comprising an escarpment facing said second upwardly extending leg, and having a fourth pair of longitudinal legs extending downwardly, said fourth pair of legs fitting within the channel of said bottom track, so that said bottom track locates and supports said panel support track;

a first elongated L-shaped member having a third longitudinal leg extending upwardly and having a third horizontal surface with a third longitudinal lip extending therefrom, said third lip comprising an escarpment adjacent to the escarpment of said first lip with said first L-shaped member resting on said panel support track so that said first leg and said first L-shaped member form a U-shaped channel to entrain the lower edge of said first panel; and a second elongated L-shaped member having a fourth longitudinal leg extending upwardly and having a fourth horizontal surface with a fourth longitudinal lip extending therefrom, said fourth lip comprising an escarpment adjacent to the escarpment of said first lip with said second L-shaped member resting on said panel support track so that said fourth leg and said second L-shaped member form a U-shaped channel to entrain the lower edge of said second panel.

6. A system according to claim 5 wherein said lips each comprise an escarpment at an acute angle with respect to the surface from which it extends.

7. A system according to claim 5 wherein said panel support track has a plurality of threaded, vertical holes engaging a plurality of corresponding vertical adjustment bolts, the position of said bolts determining a minimum distance between said panel support track and said bottom track, and therefore determining the height of the bottom edges of said panels above said bottom surface.

* * * * *